US007408517B1

(12) United States Patent
Poilasne et al.

(10) Patent No.: US 7,408,517 B1
(45) Date of Patent: Aug. 5, 2008

(54) TUNABLE CAPACITIVELY-LOADED MAGNETIC DIPOLE ANTENNA

(75) Inventors: Gregory Poilasne, San Diego, CA (US); Vaneet Pathak, San Diego, CA (US); Jordi Fabrega, San Diego, CA (US); Huan-Sheng Hwang, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 121 days.

(21) Appl. No.: 11/339,926

(22) Filed: Jan. 25, 2006

Related U.S. Application Data

(63) Continuation-in-part of application No. 10/940,935, filed on Sep. 14, 2004, now Pat. No. 7,239,290.

(51) Int. Cl.
*H01Q 11/12* (2006.01)

(52) U.S. Cl. ..... 343/742; 343/867; 343/793; 343/702

(58) Field of Classification Search ..... 343/742, 343/866, 867, 702, 793
See application file for complete search history.

(56) References Cited

U.S. PATENT DOCUMENTS

| | | | | |
|---|---|---|---|---|
| 3,882,506 | A | 5/1975 | Mori et al. | |
| H1571 | H | 8/1996 | Hansen et al. | |
| 6,144,346 | A | 11/2000 | Boy | |
| 6,204,817 | B1 | 3/2001 | Edvardsson | |
| 6,456,243 | B1 | 9/2002 | Poilasne et al. | |
| 6,486,848 | B1 | 11/2002 | Poilasne et al. | |
| 6,573,867 | B1 | 6/2003 | Desclos et al. | |
| 6,593,886 | B2 * | 7/2003 | Schantz | 343/700 MS |
| 6,600,450 | B1 | 7/2003 | Efanov et al. | |
| 6,624,795 | B2 * | 9/2003 | Boyle | 343/895 |
| 6,675,461 | B1 | 1/2004 | Rowson et al. | |
| 6,693,599 | B1 | 2/2004 | Chia et al. | |
| 6,697,025 | B2 | 2/2004 | Koyanagi et al. | |
| 6,765,846 | B2 | 7/2004 | Saitou et al. | |
| 6,958,735 | B2 * | 10/2005 | Handelsman | 343/742 |
| 7,187,332 | B2 * | 3/2007 | Kezys et al. | 343/702 |
| 2006/0038730 | A1 | 2/2006 | Parsche | |
| 2006/0079177 | A1 * | 4/2006 | Okubora | 455/25 |

FOREIGN PATENT DOCUMENTS

| | | |
|---|---|---|
| DE | 88 14 993 | 4/1989 |
| EP | 1 134 840 | 9/2001 |
| EP | 1 217 685 | 6/2002 |
| WO | WO 02/071536 | 9/2002 |

* cited by examiner

*Primary Examiner*—Trinh Vo Dinh
*Assistant Examiner*—Dieu Hien T Duong

(57) ABSTRACT

A frequency-tunable capacitively-loaded magnetic dipole antenna includes a transformer loop having a balanced feed interface, and a capacitively-loaded magnetic dipole radiator with a tunable effective electrical length. In one embodiment, the capacitively-loaded magnetic dipole radiator includes a tunable electric field bridge. For example, the capacitively-loaded magnetic dipole radiator may comprise a quasi loop with a tunable electric field bridge interposed between the quasi loop first and second ends. The electric field bridge may be an element such as a ferroelectric (FE) tunable capacitor or a microelectromechanical system (MEMS) capacitor, to name a couple of examples. In certain embodiments, the capacitively-loaded magnetic dipole radiator includes a quasi loop with a loop perimeter. The effective electrical length of the radiator is changed by adjusting the perimeter using an element such as a MEMS switch, or a semiconductor switch.

20 Claims, 5 Drawing Sheets

TUNABLE CAPACITIVELY-LOADED MAGNETIC DIPOLE ANTENNA

RELATED APPLICATIONS

This application is a continuation-in-part of application Ser. No. 10/940,935, filed Sep. 14, 2004 now U.S. Pat. No. 7,239,290, the disclosure of which is incorporated herein by reference.

FIELD OF THE INVENTION

This invention generally relates to wireless communications and, more particularly, to a tunable capacitively-loaded magnetic dipole antenna.

BACKGROUND OF THE INVENTION

The size of portable wireless communications devices, such as telephones, continues to shrink, even as more functionality is added. As a result, the designers must increase the performance of components or device subsystems and reduce their size, while packaging these components in inconvenient locations. One such critical component is the wireless communications antenna. This antenna may be connected to a telephone transceiver, for example, or a global positioning system (GPS) receiver.

State-of-the-art wireless telephones are expected to operate in a number of different communication bands. In the US, the cellular band (AMPS), at around 850 megahertz (MHz), and the PCS (Personal Communication System) band, at around 1900 MHz, are used. Other communication bands include the PCN (Personal Communication Network) and DCS at approximately 1800 MHz, the GSM system (Groupe Speciale Mobile) at approximately 900 MHz, and the JDC (Japanese Digital Cellular) at approximately 800 and 1500 MHz. Other bands of interest are GPS signals at approximately 1575 MHz, Bluetooth at approximately 2400 MHz, and wideband code division multiple access (WCDMA) at 1850 to 2200 MHz.

Wireless communications devices are known to use simple cylindrical coil or whip antennas as either the primary or secondary communication antennas. Inverted-F antennas are also popular. The resonance frequency of an antenna is responsive to its electrical length, which forms a portion of the operating frequency wavelength. The electrical length of a wireless device antenna is often at multiples of a quarter-wavelength, such as $5\lambda/4$, $3\lambda/4$, $\lambda/2$, or $\lambda/4$, where $\lambda$ is the wavelength of the operating frequency, and the effective wavelength is responsive to the physical length of the antenna radiator and the proximate dielectric constant.

Many of the above-mentioned conventional wireless telephones use a monopole or single-radiator design with an unbalanced signal feed. This type of design is dependent upon the wireless telephone printed circuit boards groundplane and chassis to act as the counterpoise. A single-radiator design acts to reduce the overall form factor of the antenna. However, the counterpoise is susceptible to changes in the design and location of proximate circuitry, and interaction with proximate objects when in use, i.e., a nearby wall or the manner in which the telephone is held. As a result of the susceptibility of the counterpoise, the radiation patterns and communications efficiency can be detrimentally impacted.

SUMMARY OF THE INVENTION

A frequency-tunable capacitively-loaded magnetic dipole radiator antenna is disclosed. The antenna is balanced, to minimize the susceptibility of the counterpoise to detuning effects that degrade the far-field electromagnetic patterns. A balanced antenna, when used in a balanced RF system, is less susceptible to RF noise. Both feeds are likely to pick up the same noise and, thus, be cancelled. Further, the use of balanced circuitry reduces the amount of current circulating in the groundplane, minimizing receiver desensitivity issues.

The balanced antenna also acts to reduce the amount of radiation-associated current in the groundplane, thus improving receiver sensitivity. The antenna loop is a capacitively-loaded magnetic dipole, to confine the electric field and so reduce the overall size (length) of the radiating elements. Further, the antenna's radiator is tunable, to as to be optimally efficient at a plurality of channels inside a frequency band, or to be optimal efficient in different frequency bands.

Accordingly, a frequency-tunable capacitively-loaded magnetic dipole antenna is provided. The antenna includes a transformer loop having a balanced feed interface, and a capacitively-loaded magnetic dipole radiator with a tunable effective electrical length. More specifically, the capacitively-loaded magnetic dipole radiator includes a tunable electric field bridge. For example, the capacitively-loaded magnetic dipole radiator may comprise a quasi loop with a first end and a second end, with the tunable electric field bridge interposed between the quasi loop first and second ends. The electric field bridge may be an element such as a ferroelectric (FE) tunable capacitor or a microelectromechanical system (MEMS) capacitor, to name a couple of examples. In this manner, the electric field is tuned in response to adjusting the capacitance of the FE or MEMS capacitor.

In certain embodiments, the capacitively-loaded magnetic dipole radiator includes a quasi loop with a loop perimeter. The effective electrical length of the radiator is changed by adjusting the perimeter, using an element such as a MEMS switch or a semiconductor switch. For example, a MEMS switch can be used to connect in different lengths of perimeter. In one aspect, auxiliary loop sections can be switch in to modify the quasi loop perimeter. In another aspect, the effective electrical length can be changed using a combination of quasi loop perimeter and electric field bridge adjustments.

Additional details of the above-described antenna, a wireless device with a frequency-tunable capacitively-loaded magnetic dipole antenna, and a method for frequency tuning a capacitively-loaded magnetic dipole antenna are presented below.

DETAILED DESCRIPTION

Figure 1:
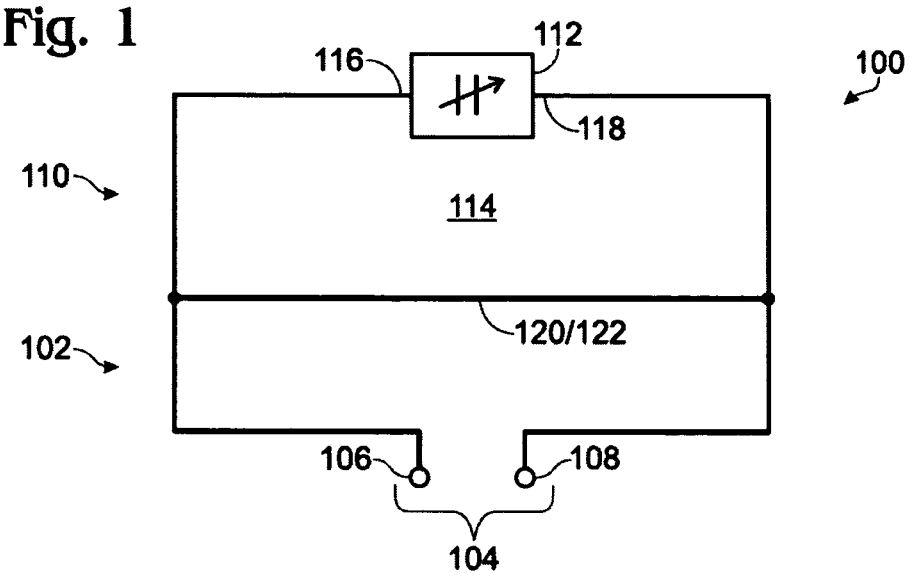
FIG. 1 is a plan view of a frequency-tunable capacitively-loaded magnetic dipole antenna.

FIG. 1 is a plan view of a frequency-tunable capacitively-loaded magnetic dipole antenna. The antenna 100 comprises a transformer loop 102 having a balanced feed interface 104. The balanced feed interface 104 accepts a positive signal on line 106 and a negative signal (considered with respect to the positive signal) on line 108. In some aspects, the signal on line 108 is 180 degrees out of phase with the signal on line 106. The antenna 100 also comprises a capacitively-loaded magnetic dipole radiator 110, having a tunable (variable) effective electrical length. The effective electrical length is related to the physical length of the radiator 110, and subject to the influence of the adjacent dielectric through which the magnetic radiation propagates.

In one aspect, the capacitively-loaded magnetic dipole radiator 110 comprises an electric field bridge 112. If enabled as a dielectric gap, or lumped element capacitor for example, the electric field across the bridge 112 remains fixed. However, the electric field bridge 112 can be made tunable, thus affecting the effective electrical length and ultimately, the frequency at which the radiator 110 is tuned.

The capacitively-loaded magnetic dipole radiator 110 comprises a quasi loop 114 with a first end 116 and a second end 118. The tunable electric field bridge 112 is interposed between the quasi loop first end 116 and the second end 118. For example, the bridge 112 can be an element such as a varactor diode, ferroelectric (FE) capacitor, PN Junction diode, MOS transistor, or a microelectromechanical system (MEMS) capacitor. Any one of the above-mentioned elements can vary capacitance sufficiently to permit the antenna 100 to be tuned between relatively narrow channels within a larger overall frequency band.

The antenna 100 of FIG. 1 can be understood as a confined electric field magnetic dipole antenna. That is, the antenna can be considered as comprising a quasi loop 114 acting as an inductive element, and a bridge 112 that confines an electric field between the quasi loop first and second end sections 116/118. The magnetic dipole radiator 110 can be a balanced radiator, or quasi-balanced. For simplicity, quasi-balanced antennas are described herein that use an electric field bridge to couple between the quasi loop sections. Balanced radiators are described in the parent applications from which the instant application continues, and they are incorporated herein by reference.

Unlike conventional dipole antennas, which operate by generating an electric field (E-field) between radiators, a capacitively-loaded magnetic dipole operates by generating a magnetic field (H-field) through the quasi loop 114. The bridge 112, or confined electric field section, couples or conducts substantially all the electric field between first and second end sections 116/118. As used herein, "confining the electric field" means that the near-field radiated by the antenna is mostly magnetic. Thus, the magnetic field that is generated has less of an interaction with the surroundings or proximate objects. The reduced interaction can positively impact the overall antenna efficiency.

The transformer loop 102 has a radiator interface 120. Likewise, the quasi loop 114 has a transformer interface 122 coupled to the transformer loop radiator interface 120. As shown, the interfaces 120 is a first side of the transformer loop 102, and the quasi loop 114 has a perimeter that shares the first side 120 with the transformer loop 102. That is, interfaces 120 and 122 are a shared perimeter portion from both the transformer loop 102 and the quasi loop 114. However, as presented in the parent applications from which this application continues, and which are incorporated by reference, there are other means of coupling the transformer loop 102 to the quasi loop 114.

For simplicity the invention will be described in the context of rectangular-shaped loops. However, the transformer loop 102 and quasi loop 114 are not limited to any particular shape. For example, in other variations not shown, the transformer loop 102 and quasi loop 114 may be substantially circular, oval, shaped with multiple straight sections (i.e., a pentagon shape). Further, the transformer loop 102 and quasi loop 114 need not necessary be formed in the same shape. Even if the transformer loop 102 and the quasi loop 110 are formed in substantially the same shape, the perimeters or areas surrounded by the perimeters need not necessarily be the same. Further, although the transformer loop 102 and quasi loop 114 are shown as coplanar for simplicity, it should be understood that non-coplanar variations of the antennas described herein can be enabled.

Figure 2:
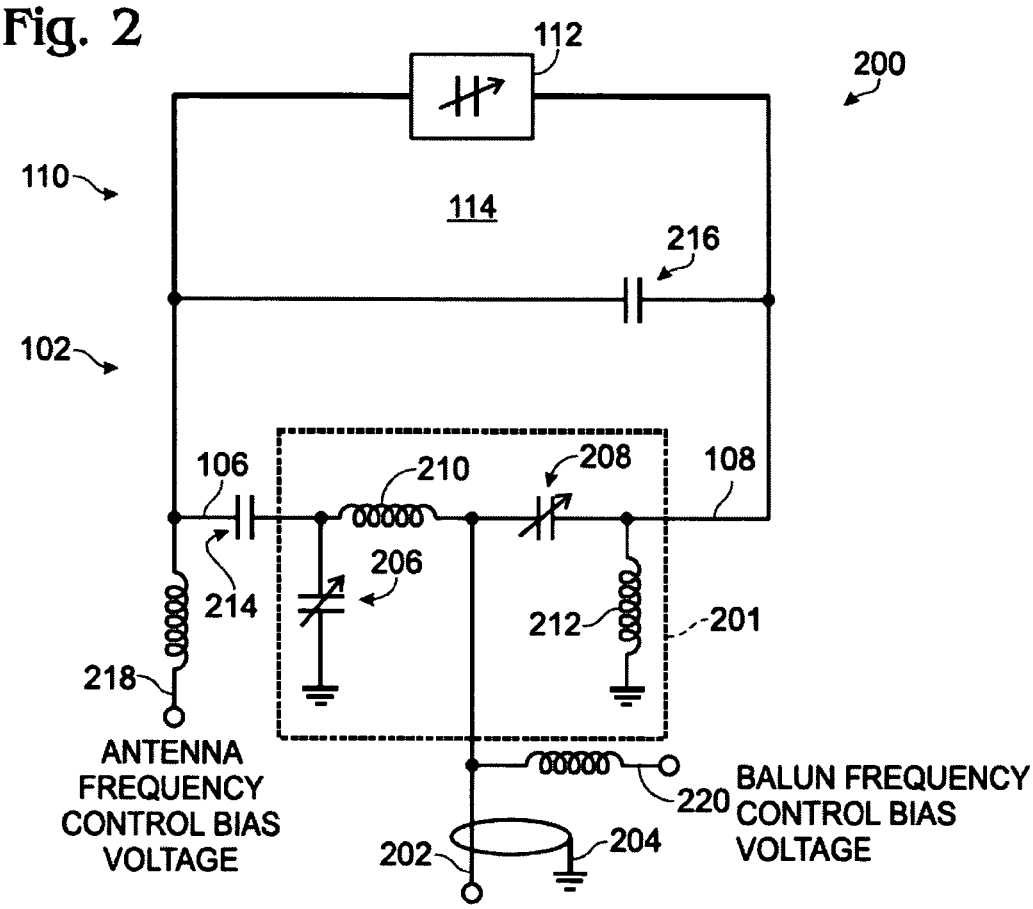
FIG. 2 is a plan view of a capacitively-loaded magnetic dipole antenna, where an FE capacitor is used as the tunable electric field bridge.

FIG. 2 is a plan view of a capacitively-loaded magnetic dipole antenna, where an FE capacitor is used as the tunable electric field bridge 112. The antenna 200 of FIG. 2 also comprises a tunable balun 201. The balun 201 accepts an unbalanced signal on line 202, referenced to a dc voltage such as ground 204. The balun 201 "converts" the unbalanced signal on line 202 to a balanced signal on lines 106 and 108. The balun 201 is comprised of FE capacitors 206 and 208, as well as inductors 210 and 212, which permit the balun impedance to be controlled. Blocking capacitors 214 and 216 permits the bridge capacitor 112 to be biased with a dc voltage on line 218, while the balun capacitors 206/208 are biased via line 220. A tunable balun 201 is desirable, since the input impedance between lines 106 and 108 varies in response to changing the effective electrical length of the radiator 110. A tunable balun 201 acts as a variable impedance transformer, which optimally matches between the antenna impedance and the impedance on line 202.

Figure 3A:
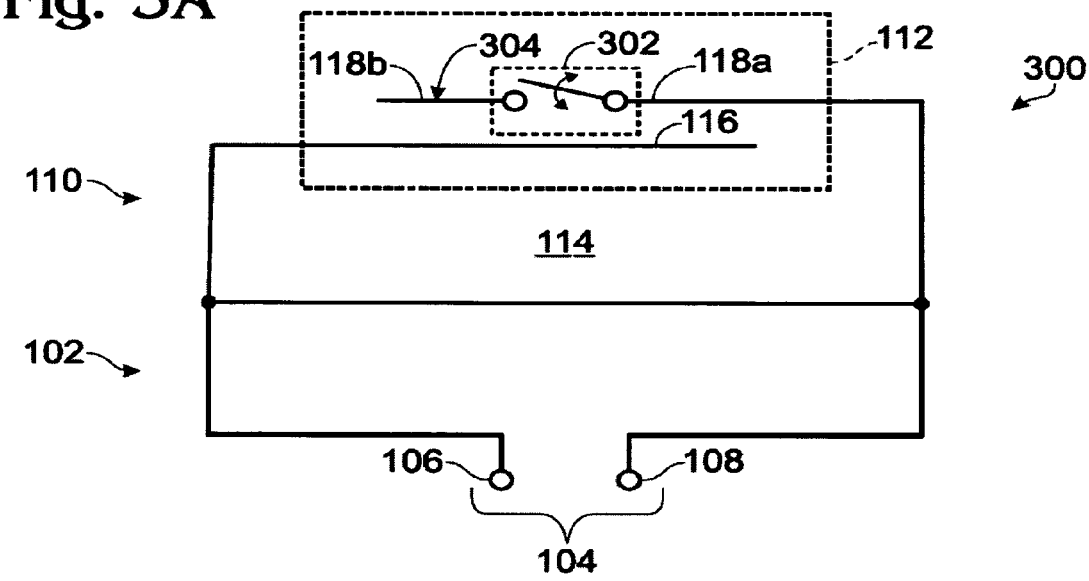
FIGS. 3A and 3B are plan views of capacitively-loaded magnetic dipole antennas with an adjustable quasi loop perimeters.
Figure 3B:
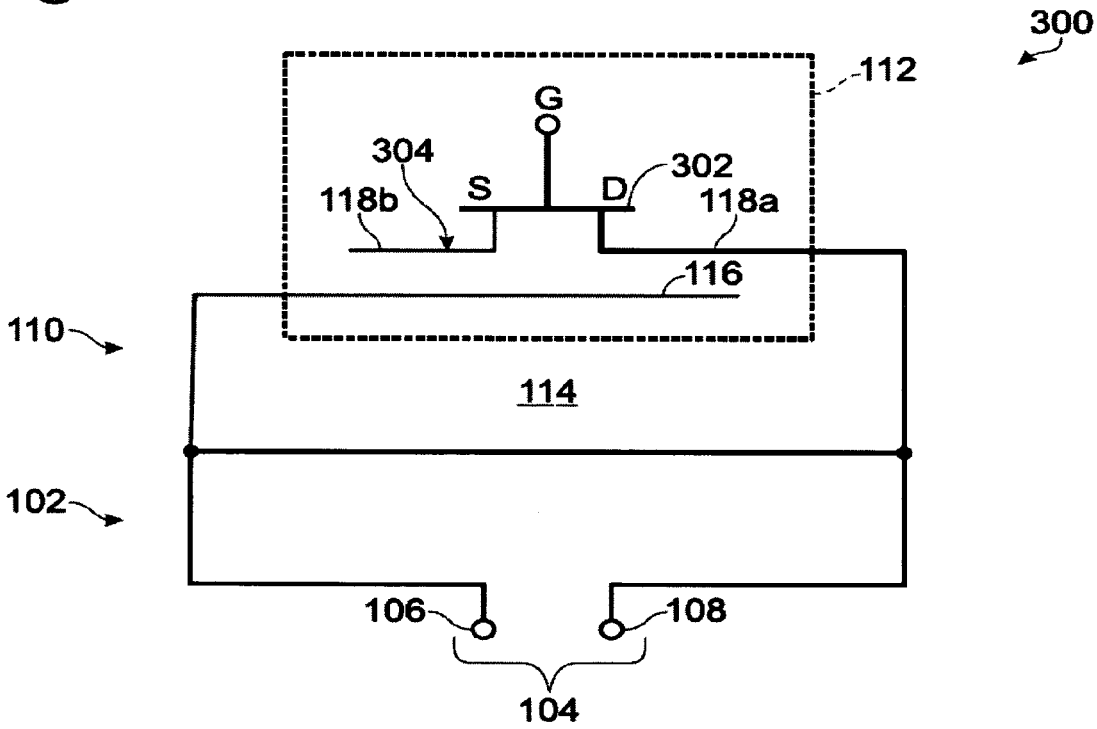

FIGS. 3A and 3B are plan views of capacitively-loaded magnetic dipole antennas with an adjustable quasi loop perimeters. In this aspect of the antenna 300, the quasi loop 114 has an adjustable loop perimeter. As shown, the perimeter of the quasi loop 114 can be shortened by switching element 302 to disconnect line quasi loop perimeter segment 304 from the quasi loop 114. In certain embodiments, the perimeter can be lengthened by switching element 302 to connect segment 304. Element 302 may be a MEMS switch or a semiconductor switch. In FIG. 3A, a MEMS switch is represented by reference designator 302. In FIG. 3B, a MOSFET source is connected to line end 304 and the drain is connected to line end 306. The MOSFET gate can be used to control the impedance between source and drain. In both figures, the electric field bridge 112 is an air or dielectric gap capacitor. For example, the transformer loop 102 and radiator 110 may be conductive microstrip traces on a printer circuit board (PCB), in which case the dielectric material is primarily the PCB dielectric.

As in FIGS. 1 and 2, an electric field bridge 112 is interposed between quasi loop first ends 116 and second end 118.

However, the position of second end can be one of two different positions: 118*a* or 118*b*, depending on the switch position. In the aspect shown, the electric field bridge 112 is not generally tunable, except to the extent that the switched line segment 304 causes a change in capacitance across the electric field bridge 112. In other aspects the electric field bridge 112 can be a fixed-tuned element such as an interdigital gap capacitor, a lumped element capacitor, or a surface-mounted capacitor, to name a few possible examples, which may make the field across the bridge 112 less susceptible to changes in perimeter length. Although not specifically shown, this antenna can be interfaced to a tunable balun, as described in the explanation of FIG. 2.

Figure 4A:
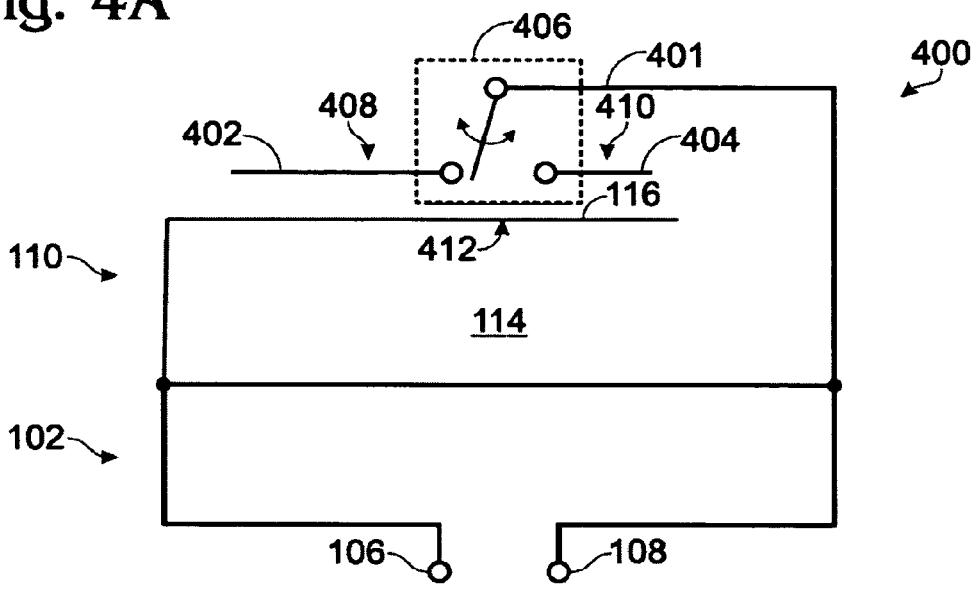
FIGS. 4A and 4B are plan views showing a first variation of a capacitively-loaded magnetic dipole antenna with an adjustable quasi loop perimeter.
Figure 4B:
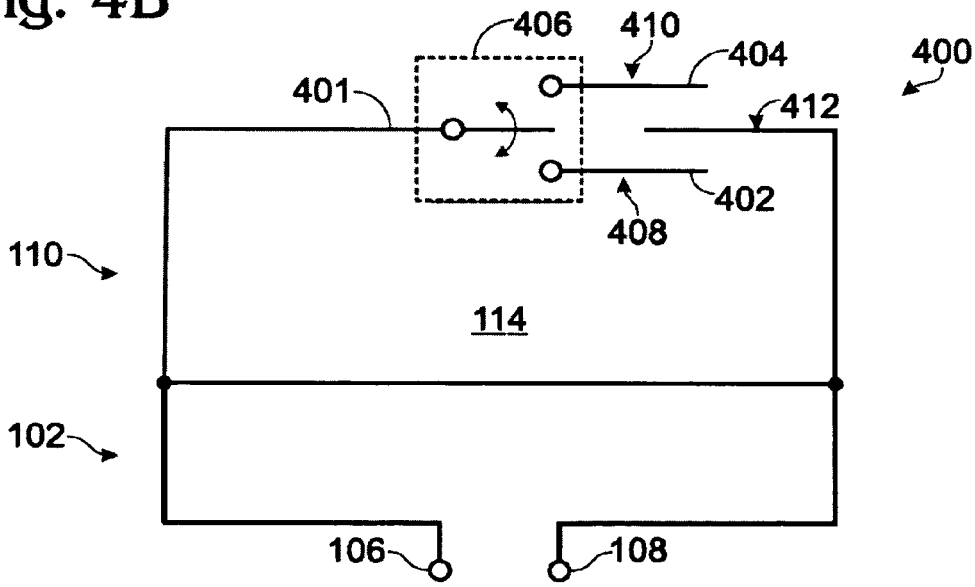

FIGS. 4A and 4B are plan views showing a first variation of a capacitively-loaded magnetic dipole antenna 400 with an adjustable quasi loop perimeter. As show, the quasi loop 114 has a first end 401, a selectable second end 402, and a selectable third end 404. MEMS switch 406 is a single-pole double-throw (SPDT) switch that either connects the quasi loop second end 402 in a first switch position, or connects the quasi loop third end 404 in a second switch position. As shown, the quasi loop 114 has a longer length (perimeter) when connected in the first position to line 402, than it does when connected to line end 404.

In FIG. 4A, line segments 408 and 410 are both aligned above line segment 412. In FIG. 4B, connectable line segments 408 and 410 are shown respectively aligned "below" and "above" line segment 412. However, it should be understood that there are numerous arrangements of line segments alignments possible. Further, although a SPDT switch as been shown, the antenna is not limited to merely double throw switches. Although not specifically shown, this antenna can be interfaced to a tunable balun, as described in the explanation of FIG. 2.

Figure 5:
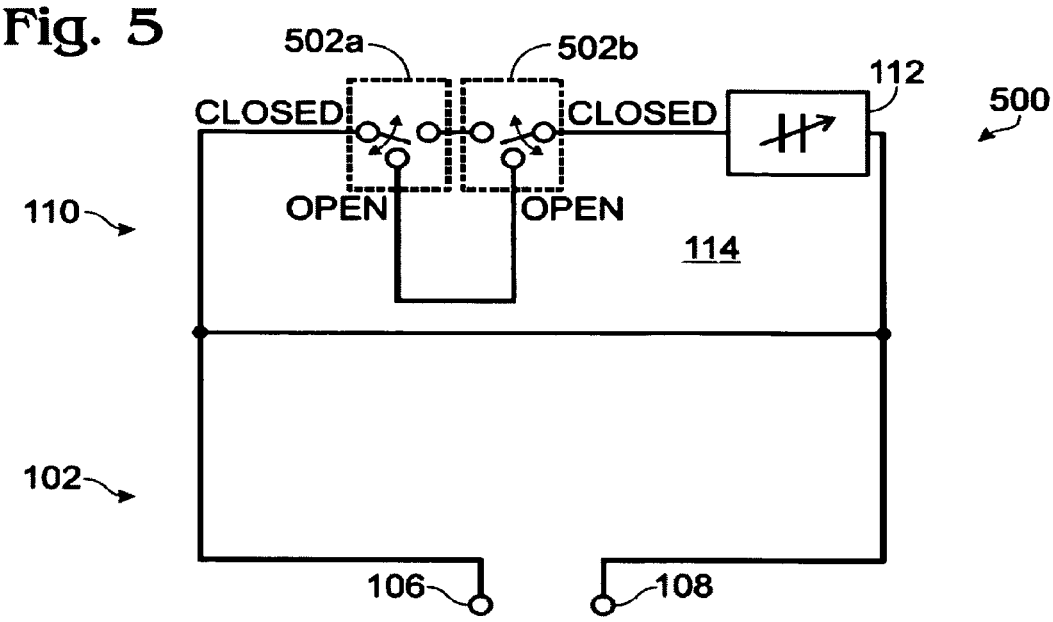
FIG. 5 is a plan view showing a second variation of a capacitively-loaded magnetic dipole antenna with an adjustable quasi loop perimeter.

FIG. 5 is a plan view showing a second variation of a capacitively-loaded magnetic dipole antenna with an adjustable quasi loop perimeter. In this aspect, the electric field bridge 112 can be made tunable, as the bridges described in the explanation of FIGS. 1 and 2. Large changes in the effective electric length of antenna 500 can be enabled by changing the length of the quasi loop perimeter with elements 502. Here, the perimeter length is changed by creating a bridge between sections of the quasi loop 114, using 502*a* and 502*b* to shorten the overall perimeter length. Note, when element 502*a* is closed, element 502*b* is closed. Likewise, when element 502*a* is open, element 502*b* is open.

In certain embodiments, the perimeter length can be changed using one of the approaches shown in FIG. 3A, 3B, 4A, or 4B. Smaller adjustments in effective electric length can be obtained by tuning the electric field bridge 112. Again, it should be understood that there are numerous arrangements of line segments alignments, switch positions, and bridge positions are possible. Further, although SPDT switches have been shown, the antenna 500 is not limited to merely double throw switches. Although not specifically shown, this antenna can be interfaced to a tunable balun, as described in the explanation of FIG. 2.

Figure 6:
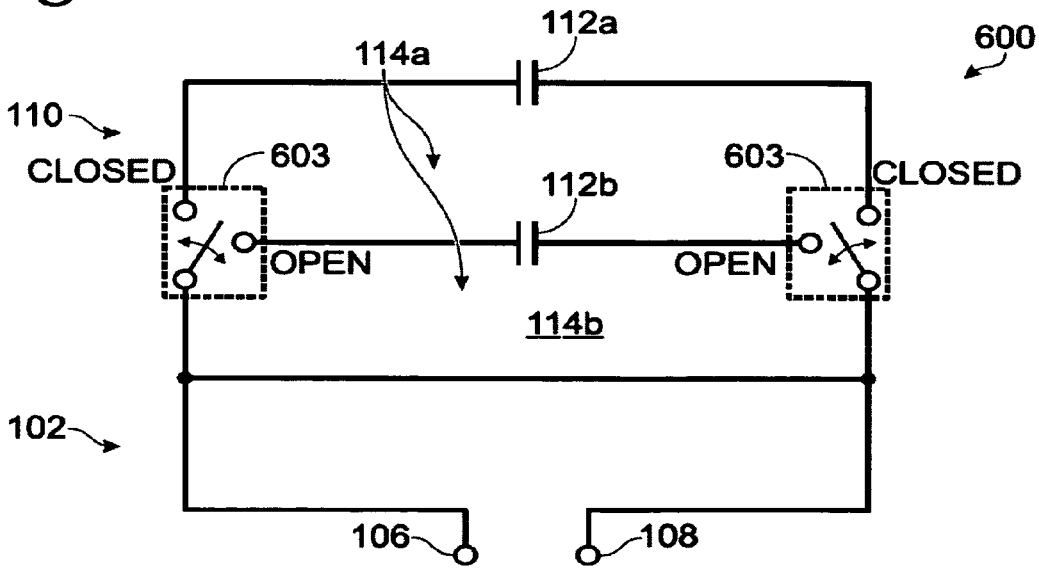
FIG. 6 is a plan view showing a third variation of a capacitively-loaded magnetic dipole antenna with an adjustable quasi loop perimeter.

FIG. 6 is a plan view showing a third variation of a capacitively-loaded magnetic dipole antenna 600 with a selectable quasi loop perimeter. In this aspect, the capacitively-loaded magnetic dipole radiator 110 includes a first (large) quasi loop 114*a*, which is formed by closing switches 603. Bridge 112*a* is used when quasi loop 114*a* is selected. A second (smaller) quasi loop 114*b* is formed by opening switches 603. When quasi loop 114*b* is selected, then bridge 112*b* is used. Two SPDT switches either connect to the large loop or to a smaller loop. The small loop has the same general characteristics as the large loop. Regardless of which quasi loop is selected, the design remains quasi symmetrical. Thus, the balanced nature of the antenna is maintained, and the switches 603 can be used is used to tune from one frequency to another. The electric field bridges 112*a* and 112*b* can either be a fixed value or tunable as described in the explanation of FIGS. 1 and 2. Although not specifically shown, this antenna can be interfaced to a tunable balun, as described in the explanation of FIG. 2.

Figure 7:
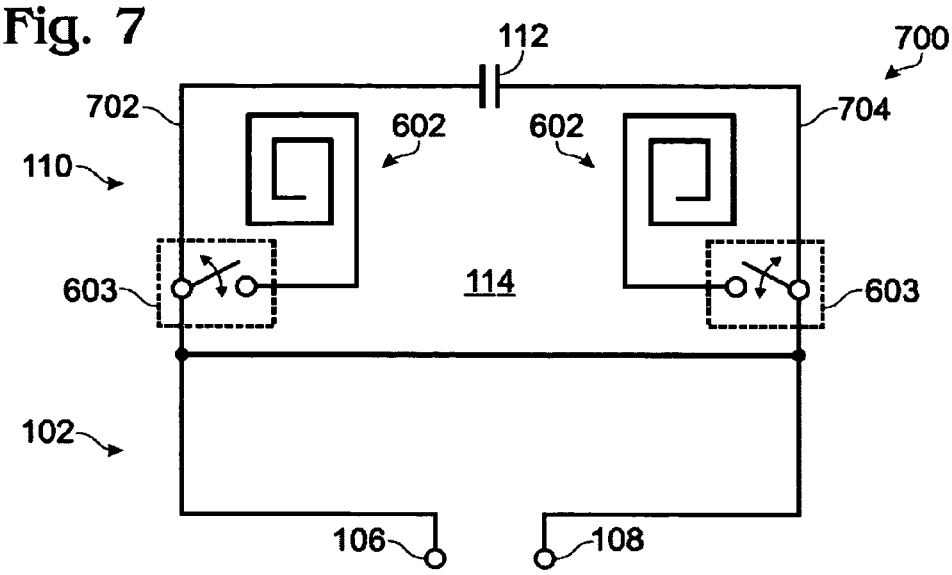
FIG. 7 is a plan view showing a fourth variation of a capacitively-loaded magnetic dipole antenna with an adjustable quasi loop perimeter.

FIG. 7 is a plan view showing a fourth variation of a capacitively-loaded magnetic dipole antenna 700 with an adjustable quasi loop perimeter. In this aspect, the capacitively-loaded magnetic dipole radiator 110 includes a quasi loop 114 with a plurality of selectable connectable auxiliary loop sections 600. As shown, there are two auxiliary loop sections 602 selectively connectable using switch elements 603.

Note, auxiliary loop sections 602 can be placed either inside (as shown) or outside the quasi loop 114, or both inside and outside. The auxiliary loop section 602 may also be connected to other sides of the quasi loop 114, besides the sides 702 and 704 shown in the figure. The electric field bridge 112 can either be a fixed value or tunable as described in the explanation of FIGS. 1 and 2. As described above, the auxiliary loop sections 602 can be connected with MEMS or semiconductor switches, although the antenna is not limited to any particular switch technology. Although not specifically shown, this antenna can be interfaced to a tunable balun, as described in the explanation of FIG. 2.

Figure 8:
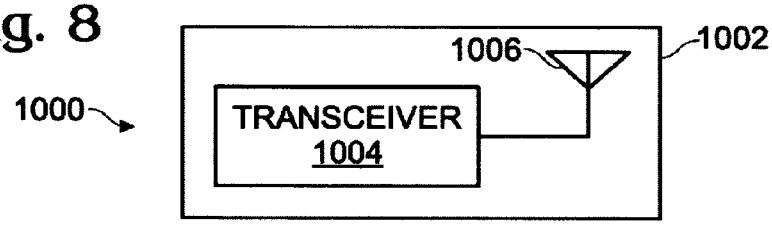
FIG. 8 is a schematic block diagram of a wireless telephone communications device with a frequency-tunable capacitively-loaded magnetic dipole antenna.

FIG. 8 is a schematic block diagram of a wireless telephone communications device with a frequency-tunable capacitively-loaded magnetic dipole antenna. The device 1000 comprises a housing 1002 and a telephone transceiver 1004 embedded in the housing 1002. A balanced feed capacitively-loaded magnetic dipole antenna 1006 is embedded in the housing 1002, and has a radiator with tunable effective electrical length. As explained above, the effective electrical length of the radiator can be varied by using a tunable electric field bridge, an adjustable quasi loop perimeter, or an adjustable electric field bridge in combination with an adjustable perimeter. Typically, the capacitively-loaded magnetic dipole antenna 1006 has a radiation efficiency that is insensitive to the proximity of the placement of a user's hand on the housing 1002.

The invention is not limited to any particular communication format, i.e., the format may be Code Division Multiple Access (CDMA), Global System for Mobile Communications (GSM), or Universal Mobile Telecommunications System (UMTS). Neither is the device 1000 limited to any particular range of frequencies. Details of antenna variations are provided in the explanations of FIGS. 1 through 7, above, and will not be repeated in the interests of brevity. Note, the invention is also applicable to other portable wireless devices, such as two-way radios, GPS receivers, Wireless Local Area Network (WLAN) transceivers, to name a few of examples.

Functional Description

Balanced antennas do not make use of the ground plane in order to radiate. This means that a balanced antenna can be located in a very thin wireless device, without detrimental affecting radiation performance. In fact, the antenna can be located within about 2 to 3 mm of a groundplane with no noticeable effect upon performance. The antenna is also less sensitive to currents on the ground plane, such as noise currents, or currents that are related to Specific Absorption Rate (SAR). Since the antenna can be made coplanar, it can be realized on a flex film, for example, at a very low cost.

Figure 9:
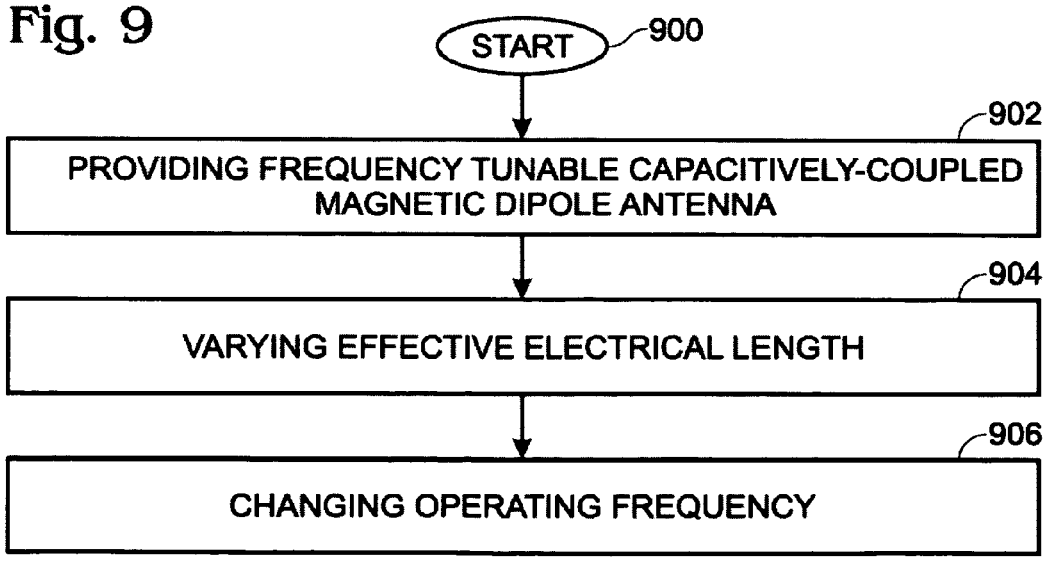
FIG. 9 is a flowchart illustrating a method for frequency tuning a capacitively-coupled magnetic dipole antenna.

FIG. 9 is a flowchart illustrating a method for frequency tuning a capacitively-coupled magnetic dipole antenna. Although the method is depicted as a sequence of numbered steps for clarity, no order need be inferred from the numbering. It should be understood that some of these steps may be performed in parallel, or performed without the requirement of maintaining a strict order of sequence. The method starts at Step 900.

Step 902 provides a capacitively-loaded magnetic dipole antenna with a transformer loop having a balanced feed interface, and a capacitively-loaded magnetic dipole radiator connected to the transformer loop, having an effective electrical length (see FIGS. 1-7, and their explanations above). Step 904 varies the effective electrical length of the radiator. Step 906 changes the antenna operating frequency in response to varying the effective electrical length of the radiator.

In one aspect, Step 902 provides a capacitively-loaded magnetic dipole radiator with an electric field bridge. Then, Step 904 varies the effective electrical length of the radiator by varying the electric field across the electric field bridge. In another aspect, Step 902 provides a capacitively-loaded magnetic dipole radiator having a quasi loop with an adjustable perimeter. Then, Step 904 varies the effective electrical length of the radiator by varying the quasi loop perimeter. In certain embodiments, Step 904 varies the effective electric length is response to both varying the quasi loop perimeter and the field across the electric field bridge.

A balanced feed, frequency-tunable capacitively-loaded magnetic dipole antenna has been provided. Some specific examples of loop shapes, loop orientations, bridge and quasi loop sections, physical implementations, and uses have been given to clarify the invention. However, the invention is not limited to merely these examples. Other variations and embodiments of the invention will occur to those skilled in the art.

What is claimed is:

1. A frequency-tunable capacitively-loaded magnetic dipole antenna, the antenna comprising:

a transformer loop having a balanced feed interface; and a capacitively-loaded magnetic dipole radiator connected to the transformer loop, the capacitively-loaded magnetic dipole radiator having a tunable effective electrical length and including at least a quasi loop with a selectively connectable auxiliary loop section.

2. The antenna of claim 1 wherein the capacitively-loaded magnetic dipole radiator comprises a tunable electric field bridge.

3. The antenna of claim 2 wherein the quasi loop includes at least a first end and a second end, and wherein the tunable electric field bridge is interposed between the quasi loop first and second ends.

4. The antenna of claim 3 wherein the tunable electric field bridge is an element selected from the group consisting of a varactor diode, ferroelectric (FE) capacitor, PN Junction diode, MOS transistor, and a microelectromechanical system (MEMS) capacitor.

5. The antenna of claim 1 wherein the quasi loop includes at least an adjustable loop perimeter.

6. The antenna of claim 5 wherein the quasi loop adjustable perimeter includes an element selected from the group consisting of a MEMS switch and a semiconductor switch.

7. The antenna of claim 6 wherein the quasi loop has a first end, a selectable second end, and a selectable third end;

wherein the MEMS switch is a single-pole double-throw switch to connect the quasi loop second end in a first switch position, and to connect the quasi loop third end in a second switch position.

8. The antenna of claim 5 wherein the quasi loop includes a first end, a second end, and an electric field bridge interposed between the quasi loop first and second ends.

9. The antenna of claim 8 wherein the electric field bridge is an element selected from the group consisting of a dielectric gap capacitor, an interdigital gap capacitor, a lumped element capacitor, and a surface-mounted capacitor.

10. The antenna of claim 8 wherein the electric field bridge is a tunable electric field bridge.

11. The antenna of claim 1 wherein the selectively connectable auxiliary loop section includes an element selected from the group consisting of a MEMS switch and a semiconductor switch, to selectively connect an auxiliary loop to the quasi loop.

12. The antenna of claim 1 wherein the selectively connectable auxiliary loop section includes at least one of a plurality of selectable connectable auxiliary loop sections.

13. The antenna of claim 1 wherein the quasi loop includes a first end, a second end, and an electric field bridge interposed between the quasi loop first and second ends.

14. The antenna of claim 1 further comprising:

a tunable balun having an unbalanced feed interface, the tunable balun supplying the balanced feed interface with a selectively controllable impedance.

15. A wireless telephone communications device with a frequency-tunable capacitively-loaded magnetic dipole antenna, the device comprising:

a housing;

a telephone transceiver embedded in the housing; and a balanced feed capacitively-loaded magnetic dipole antenna having a radiator with frequency-tunable electrical length, the radiator including at least a quasi loop with a selectively connectable auxiliary loop section.

16. The device of claim 15 wherein the capacitively-loaded magnetic dipole radiator comprises a tunable electric field bridge.

17. The device of claim 15 wherein the quasi loop includes at least an adjustable loop perimeter.

18. A method for frequency tuning a capacitively-loaded magnetic dipole antenna, the method comprising:

providing a capacitively-loaded magnetic dipole antenna with a transformer loop having a balanced feed interface, the capacitively-loaded magnetic dipole antenna further including at least a capacitively-loaded magnetic dipole radiator connected to the transformer loop, the capacitively-loaded magnetic dipole radiator including at least a quasi loop with a selectively connectable auxiliary loop section;

varying the effective electrical length of the radiator; and in response to varying the effective electrical length of the radiator, changing the antenna operating frequency.

19. The method of claim 18 wherein the capacitively-loaded magnetic dipole radiator includes an electric field bridge; and wherein varying the effective electrical length of the radiator includes varying the electric field across the electric field bridge.

20. The method of claim 18 wherein quasi loop includes at least an adjustable perimeter; and wherein varying the effective electrical length of the radiator includes varying the quasi loop perimeter.

* * * * *